US006244820B1

(12) United States Patent
Yilmaz

(10) Patent No.: US 6,244,820 B1
(45) Date of Patent: Jun. 12, 2001

(54) METHOD AND APPARATUS FOR MULTIFUNCTIONAL FAN

(76) Inventor: Gürsel George Yilmaz, 28202 Meadowlark La., Bonita Springs, FL (US) 34134

( * ) Notice: Subject to any disclaimer, the term of this patent is extended or adjusted under 35 U.S.C. 154(b) by 0 days.

(21) Appl. No.: 09/337,303

(22) Filed: Jun. 21, 1999

(51) Int. Cl.[7] ..... F04D 29/00

(52) U.S. Cl. ..... 416/146 R; 416/5; 416/62; 416/95; 416/247 R

(58) Field of Search ..... 416/5, 146, 95, 416/62, 124, 120, 63, 244 R, 247 R; 422/124; 239/34, 35, 36, 37, 38, 39, 40–60; 55/471, 467; 96/16, 57, 58, 66

(56) References Cited

U.S. PATENT DOCUMENTS 5,034,033 * 7/1991 Alsup, Jr. et al. ..... 96/58
5,077,825 * 12/1991 Monrose ..... 392/361
5,524,450 * 6/1996 Chen ..... 62/259.1
5,668,920 * 9/1997 Pelonis ..... 392/361
5,887,785 * 3/1999 Yilmaz ..... 237/1 R
5,904,744 * 5/1999 Kagan ..... 55/385.1

* cited by examiner

*Primary Examiner*—Edward K. Look
*Assistant Examiner*—James M. McAleenan

(57) ABSTRACT

The present invention improves both the quality and the flow of air delivered by a stationary fan such as a ceiling fan and a portable fan. Ceiling fans provide limited indoor air flow, but do not function as air conditioning and quality improvement apparatus. The present invention provides fans with an ability to increase indoor and outdoor air quality where they operate. One or a combination of a cooling unit and a heating unit and a filtering device and a secondary multidirectional fan provide consumers with air quality improvement options for stationary and portable fans to fulfill their specific needs for a given area.

6 Claims, 7 Drawing Sheets

METHOD AND APPARATUS FOR MULTIFUNCTIONAL FAN

FIELD OF THE INVENTION

The present invention lies in the field of environmental engineering and more particularly to improve the quality and the flow of air delivered by fans.

BACKGROUND OF THE INVENTION

Currently, portable and stationary fans such as a ceiling fan provide only connection for a light fixture and do not provide direct and multiple connections to air quality improvement devices. The present invention provides fans with an ability to connect one or a combination of different air quality improvement devices such as heaters, coolers, filters, UV lights to improve and condition air where they operate. Therefore consumers are provided with versatile portable and stationary fans that heats and cools and filters the air as desired.

SUMMARY OF THE INVENTION

The present invention lies in the field of environmental engineering and more particularly to improve the quality of air delivered by fans. Currently, fans such as a ceiling fan provide only built-in connection for a light fixture and do not provide direct and multiple built-in connections to air quality improvement devices. The present invention provides multifunctional portable and stationary fans that include a universal connector for one or a combination of air quality improvement devices. The universal connector include easy and safe versatile mechanical, magnetic, and electrical connections for air quality improvement devices such as filters, heaters, coolers, UV lights, electrostatic filters, and ionization devices such as ozone generators. Therefor, consumers are provided with a multifunctional fan that conditions and improves air where it operates.

DETAILED DESCRIPTION OF THE PREFERRED EMBODIMENTS

Figure 1A:
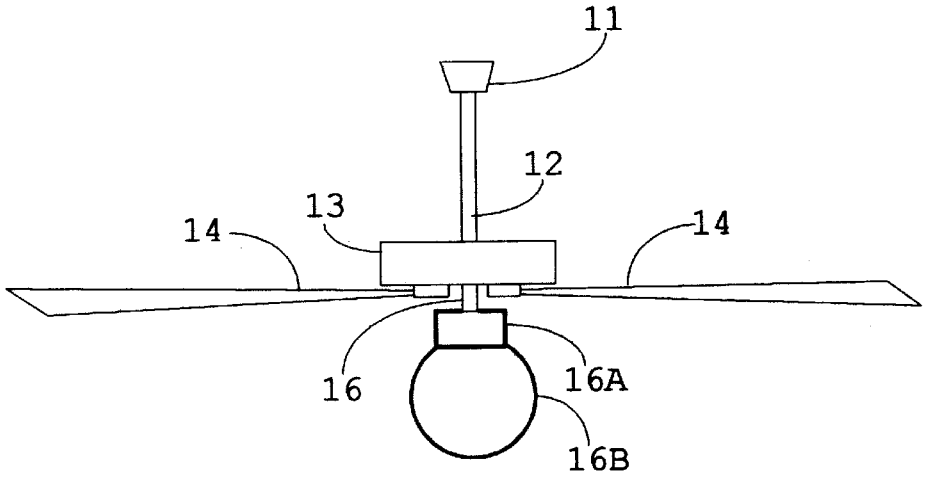
FIG. 1A shows a ceiling fan and a light fixture connection port that is attached to the ceiling fan.

FIG. 1A shows a typical ceiling fan including a light fixture connection port 16A and a ceiling connector box 11. Light fixture 16B is connected to said port 16A. Light fixture connection port 16A is only for connecting light fixtures such as 16B and is not for air quality and quantity improvement devices such as a heating unit and an UV biological filter both of which have different mechanical and electrical connection requirements. Furthermore, voltage and current (AMP) and associated cable sizes and safety requirements are not provided by said port 16A for said air improvement devices.

Figure 1B:
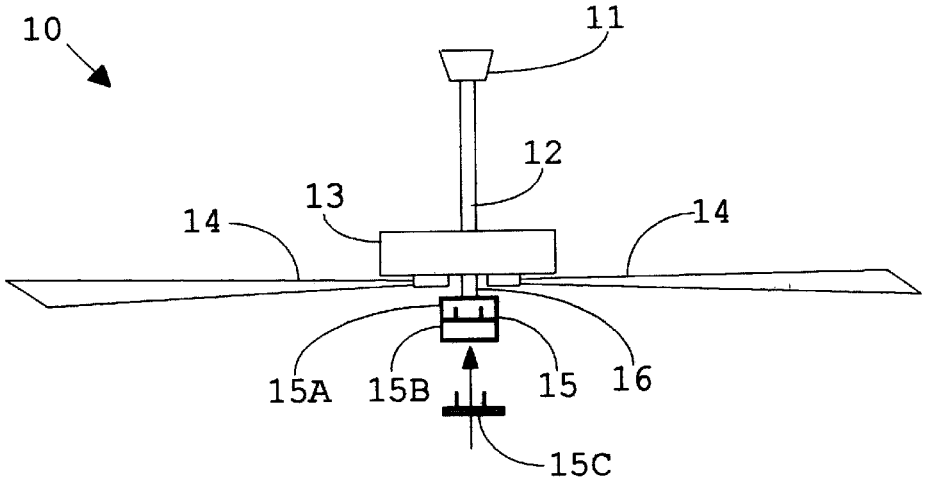
FIG. 1B shows a ceiling fan and a universal connector that is attached to the ceiling fan.

FIG. 1B shows a preferred embodiment of present invention including a stationary fan 10 attached to a ceiling by mechanical means using ceiling connection box 11 that has electrical connections to a power source. Said fan 10 includes fan rod 12 connected to box 11 and fan motor unit 13 connected to said electrical power source such as AC main or DC available from box 11 through rod 12. Fan blades 14 are connected to said motor unit 13 that has a control switch. Extension rod 16 is connected to fan rod 12 through fan motor unit 13 and a universal connector such as 15 attached to said extension rod 16. Said built-in universal connector 15 replaces light fixture ports such as 16A and provides versatile mechanical and electrical connections for air quality and quantity improvement devices. Universal connector 15 includes a vertical male connector 15A and a vertical female connector 15B. Therefor, fan light fixture connection port 16A is replaced by said female connector 15A which is connected to said male connector 15B and a blank connector 15C. Said male connector 15A is attached to an air quality and quantity improvement device. Stationary fan 10 and its universal connector 15 meet with voltage and AMP requirements of an air improvement device such as a heater and an electrostatic filter and include associated right sized cables for said voltage and AMP requirements.

Figure 2:
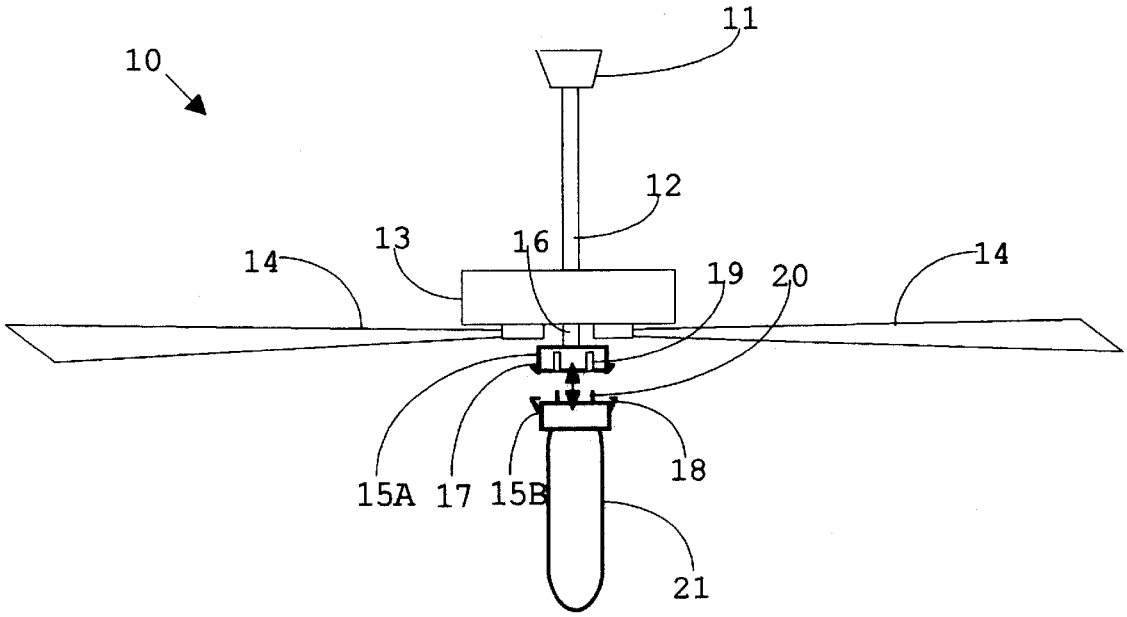
FIG. 2 shows a vertical universal connector including a male vertical connector attached to an air improvement device and a female vertical connector attached to a stationary fan.

FIG. 2 shows a vertical universal connector 15 comprising a female connector 15A and male connector 15B. Said female connector 15A is connected to fan 10 using extension rod 16 and said male connector 15B is connected to a desired air quality and quantity improvement devices such as an UV light disinfectant 21 or a light fixture. Said connector 15 includes electrical connection using female and male terminals 19 and 20 respectively and mechanical connections using female and male locking devices 17 and 18 respectively. Therefor, electrical and mechanical connections are established between stationary fan 10 and said improvement device 21 using said connector 15. The connection is easily established using said connector 15 without using any tools and without being exposed to safety hazards associated with wire-to-wire connections and open wire connectors. Said safety hazards, however, are present in light fixture connection ports such as 16A of a typical ceiling fan as shown in FIG. 1A.

Figure 3:
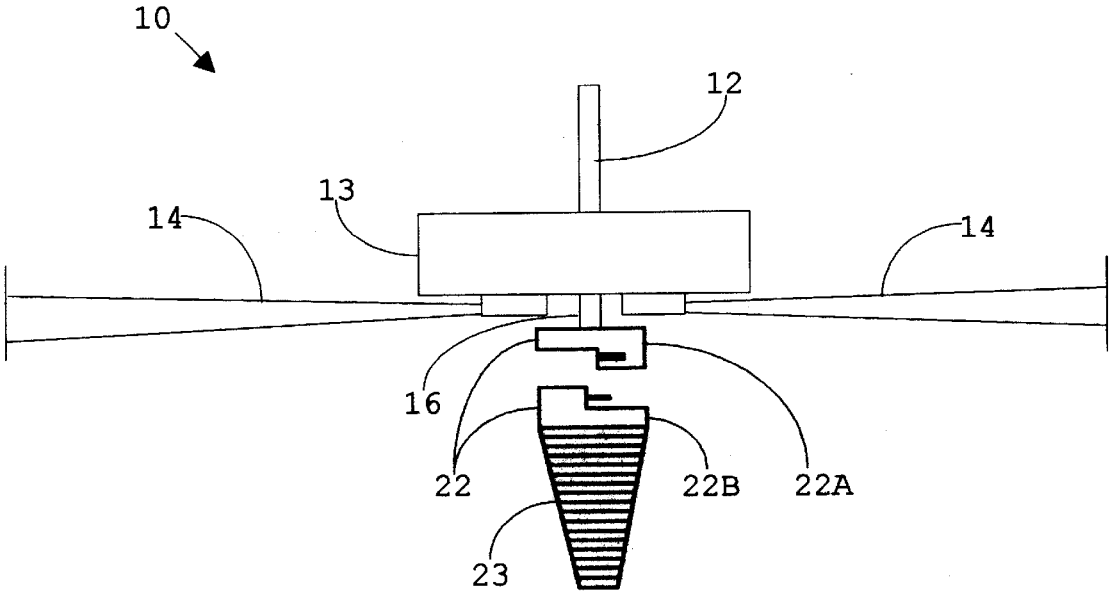
FIG. 3 shows a horizontal universal connector including a male horizontal connector attached to an air improvement device and a female horizontal connector attached to a stationary fan.

FIG. 3 shows a horizontal universal connector 22 comprising a female connector 22A and male connector 22B. Said female connector 22A is connected to fan 10 using extension rod 16 and said male connector 22B is connected to a desired air quality and quantity improvement devices such as an electrostatic filter 23 or is connected to a light fixture. Said connector 22 includes electrical connections similar to the ones explained in FIG. 2. The electrical and mechanical connections are easily established without using any tools and without being exposed to open wire connections.

Figure 4:
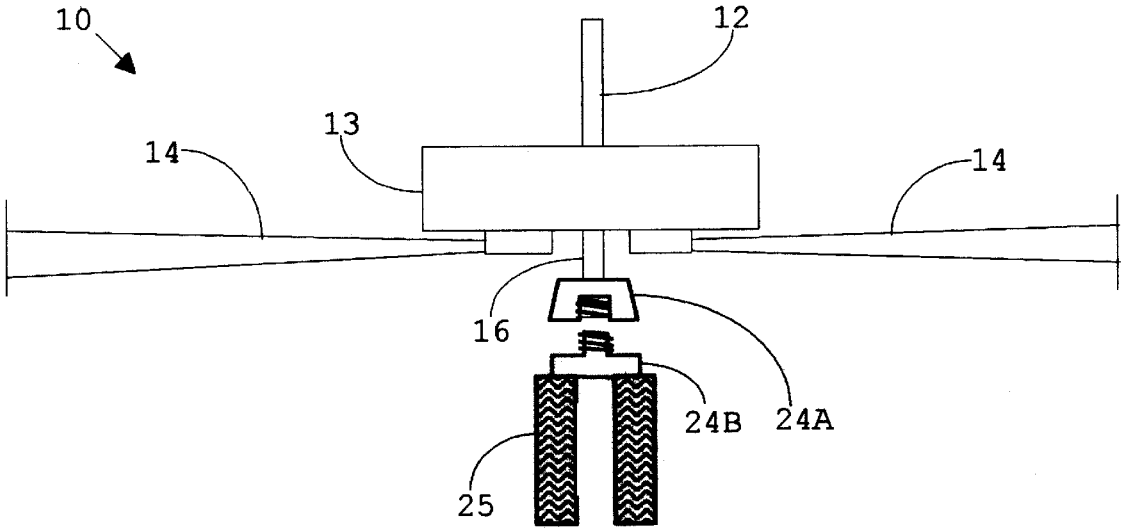
FIG. 4 shows detailed description of a rotational universal connector including a male rotational connector and a female rotational connector.

FIG. 4 shows a rotational universal connector 24 comprising a female connector 24A and male connector 24B. Said female connector 24A is connected to stationary fan 10 using extension rod 16 and said male connector 24B is connected to desired air quality and quantity improvement devices such as an ionic filter and ozone generator 25 or a light fixture. Said connector 24 includes electrical and mechanical connections between fan 10 and said improvement device 25 using connector 24. The connection is easily established without cutting off the power source and without using any tools and being exposed to safety hazards associated with open wire connections.

Figure 5A:
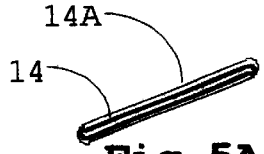
FIG. 5A shows cross section 1—1 of FIG.5 including a complementary air filter that envelops and attached to stationary fan blades.
Figure 5:
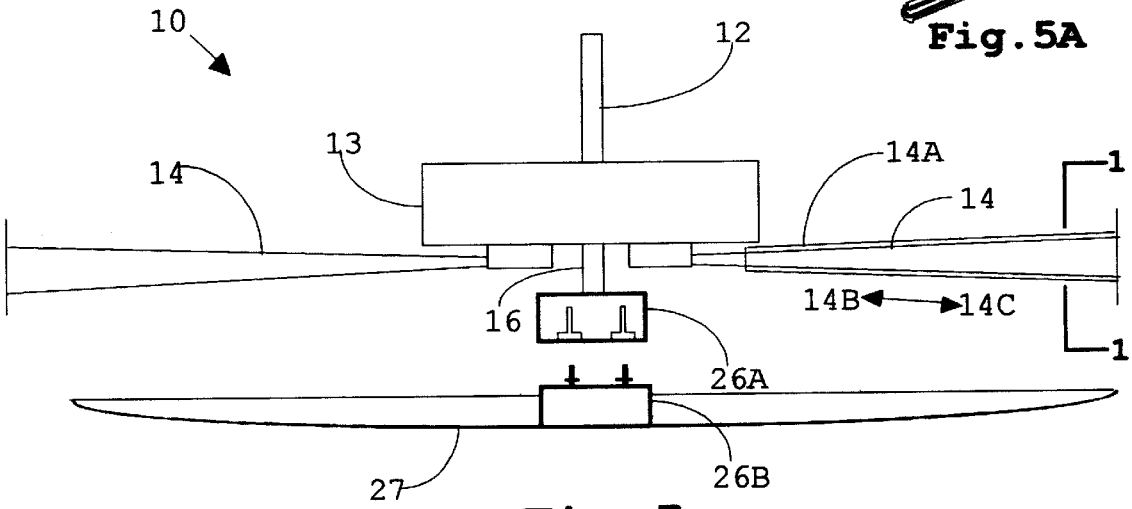
FIG. 5 shows detailed description of a self-locking universal connector including a male self-locking connector and a female self-locking connector.

FIG. 5 shows a self-locking universal connector 26 comprising a female connector 26A and male connector 26B. Said female connector 26A is connected to stationary fan 10 using extension rod 16 and said male connector 26B is connected to a desired air quality and quantity improvement devices such as a chemical filter 27. Said connector 26 includes mechanical connections between fan 10 and said improvement device 26 using said connector 26. A complementary fan blade filters 14A envelops and covers blades 14. Complementary filter 14A is easily installed by moving said filter 14A in direction of 14B and removed by moving said filter 14A in the direction of 14C over blade 14.

Figure 6:
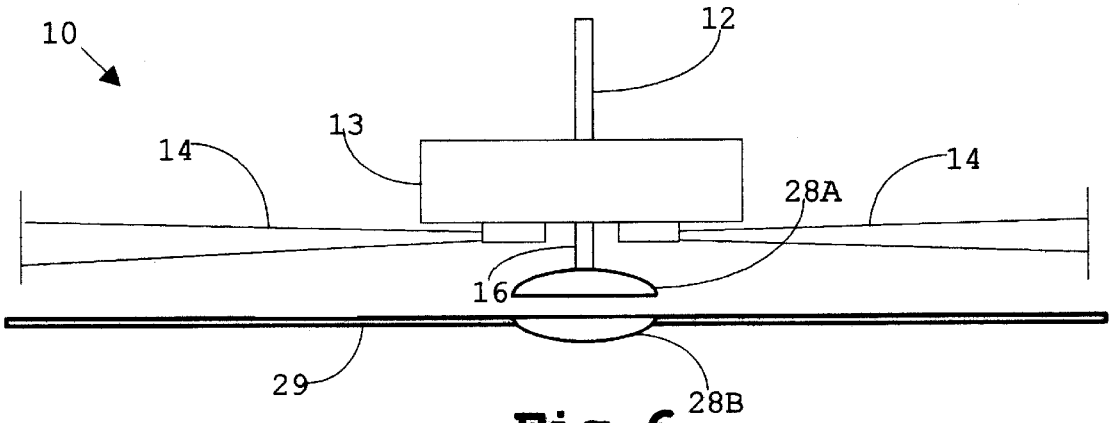
FIG. 6 shows a magnetic universal connector including a male magnetic connector and a female magnetic connector.

FIG. 6 shows a magnetic universal connector 28 comprising a female connector 28A and male connector 28B. Said female connector 28A is connected to fan 10 using extension rod 16 and said male connector 28B is connected to a desired air quality and quantity improvement devices such as a physical filter 29. Said connector 28 includes electromechanical connections between fan 10 and said improvement device 29. The connection is easily established without using any tools and without being exposed to wire connections.

Figure 7:
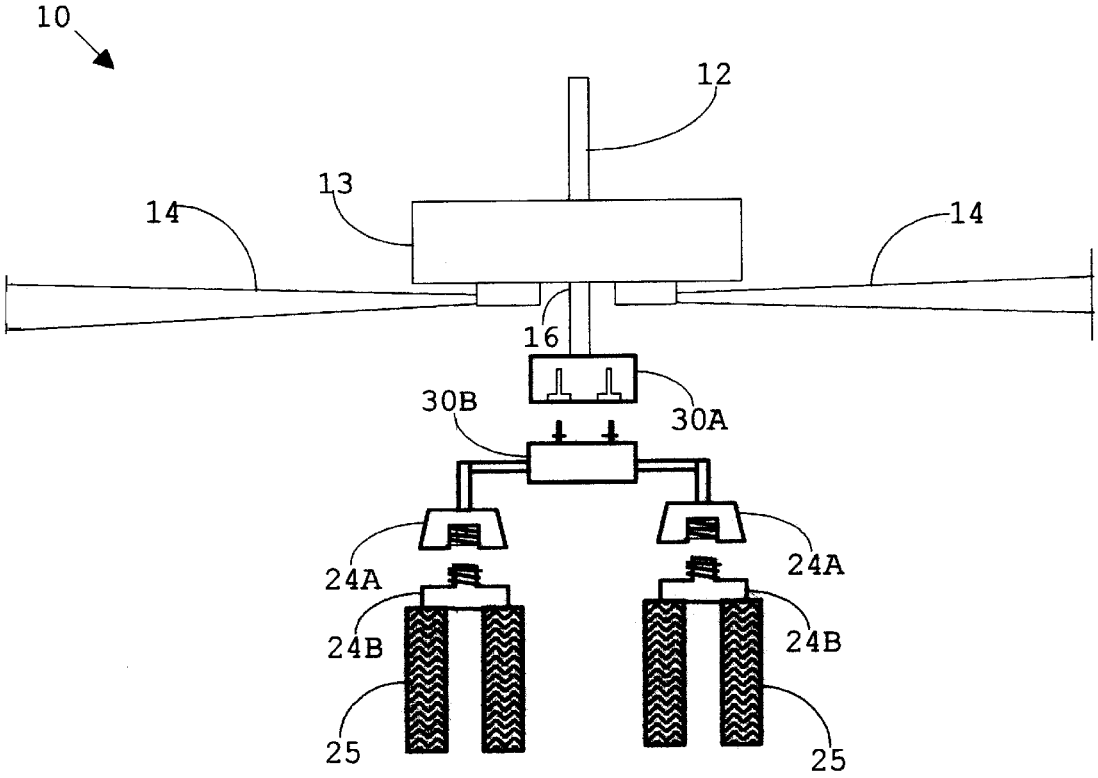
FIG. 7 shows detailed description of a multiple connector including multiple male connectors and multiple female connectors.

FIG. 7 shows a multiple connector 30 comprising more then one and a combination of universal connectors such as 24. Said universal connectors are connected to a multiple male connector 30B which is connected to ceiling fan 10 using multiple female connector 30A which is attached to extension rod 16 of said ceiling fan 10. One or more than one desired air quality and quantity improvement devices such as 25 are connected to male connector 30B using 24A and 24B. Said connector 30 includes electrical and mechanical connections between fan 10 and said improvement devices such as 25. The connection is easily established using universal connector 30 without using any tools and without being exposed to safety hazards associated with open wire connections.

Figure 8:
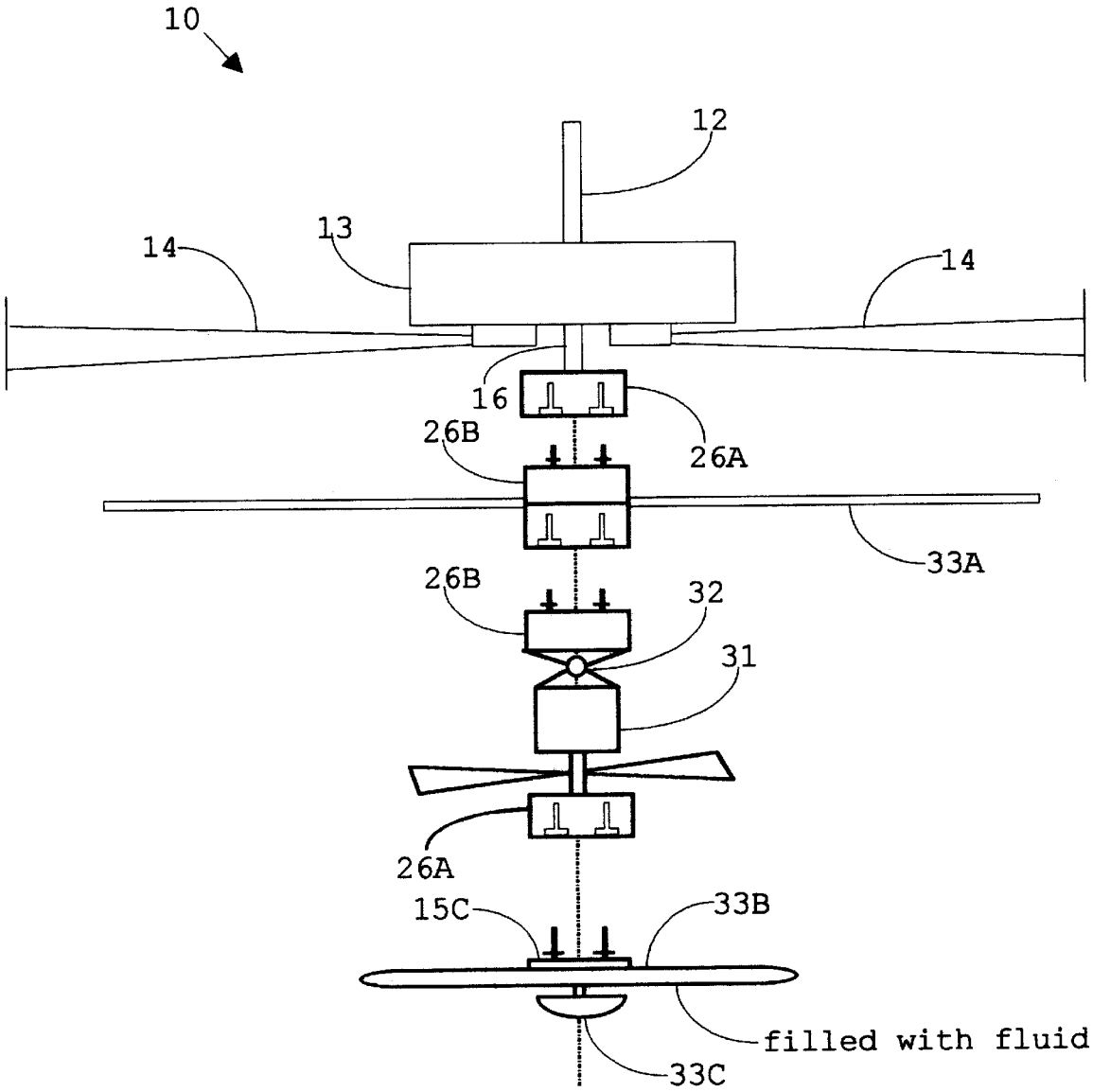
FIG. 8 shows detailed description of a number of air quality improvement devices including a secondary fan and a heating unit and a cooling unit connected to a stationary fan using an universal connector comprising a male and a female connectors.

FIG. 8 shows a secondary fan 31 with a self locking universal joint 32 and a heating and cooling unit 33 which include a heating unit 33A and a cooling unit 33B. Heating unit 33A consist of one or combination of a metal heating element and ceramic heating element and quarts/crystal heating element. Cooling unit 33B consist of a removable cooled or frozen grid filled with fluid. Said grid is cooled and frozen in an available freezer. Said cooling unit 33B is connected to said secondary fan 31 or directly connected to said stationary fan 10 using a universal blank male connector 15C attached to said unit 33B. Said male connector is connected to female connector 26A that is attached to secondary fan 31 and stationary fan 10. Said cooling unit 33B includes a condensation water retention chamber 33C build in and said chamber 33C collects condensation water. Heating unit 33A is connected to female connector 26A which is attached to said secondary fan 31 and fan 10 using male connector 26B attached to said heating unit 33A. Said heating unit 33A is to condition air in terms of temperature to more desired levels to supplement other means of indoor heating. Since air near ceilings has relatively higher temperature than air near floors, the efficiency of heating unit 33A would be higher. The secondary fan 31 with a self locking universal joint 32 can also be used to manage the direction of the air flow delivered by fan 10 to cover areas where fan 10 can not generate strong enough air circulation alone. FIG. 8 also demonstrates possible combinations of different air quality and quantity improvement devices in a desired order in sandwich construction using a universal connector and its female and male universal connectors.

Figure 9:
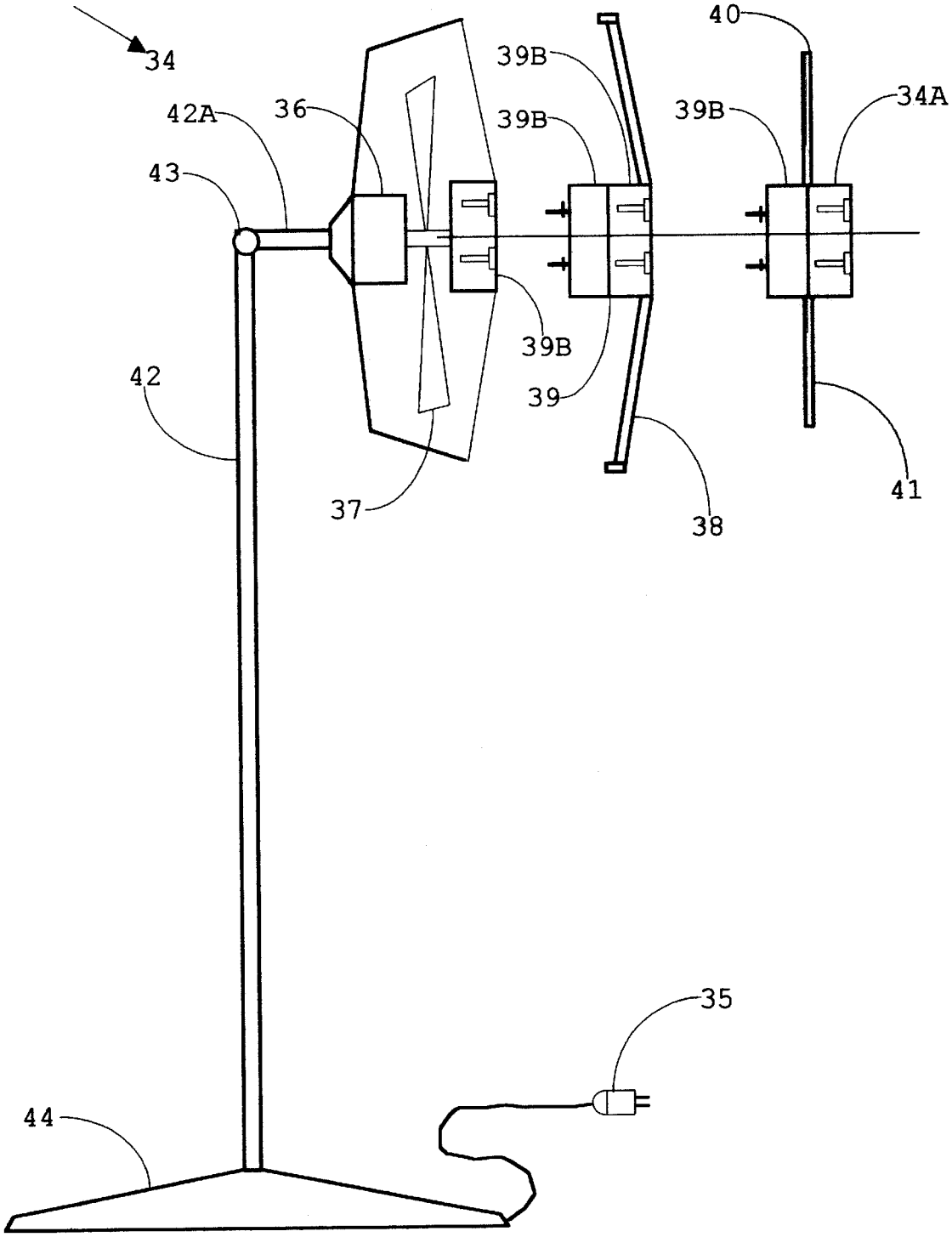
FIG. 9 shows detailed description of a portable fan including a universal connector and an air quality and quantity improvement devices such as a filter and a heating unit connected to the universal connector.

FIG. 9 shows detailed description of portable fan 34 comprising a power source 35 and a motor 36 and blades 37 connected to said motor 36 that is powered by power source 35. Air quality improvement devices such as an electrostatic filter 38 and a heating unit 40 are attached to said fan 34 using a universal connector such as 39 which includes female and male connectors 39A and 39B respectively. Heating unit 40 consist of heating element 41 which is powered by same electric power source 35 which powers fan motor 36. Universal connector 39 includes female and male connectors for electrical and mechanical connections for air quality devices. FIG. 9 also shows fan 34 which includes portable arm 42A and stand 42 that is connected to 42A using rotational joint 43 and stand leg 44 attached to stand 42. In summary, one or a combination of air quality improvement devices such as electrostatic filter and ionic filter and ozone generator and physical filter and heating unit and cooling unit and a secondary fan are connected to portable fan 34 using a universal connector such as 39.

Figures 10, 11:
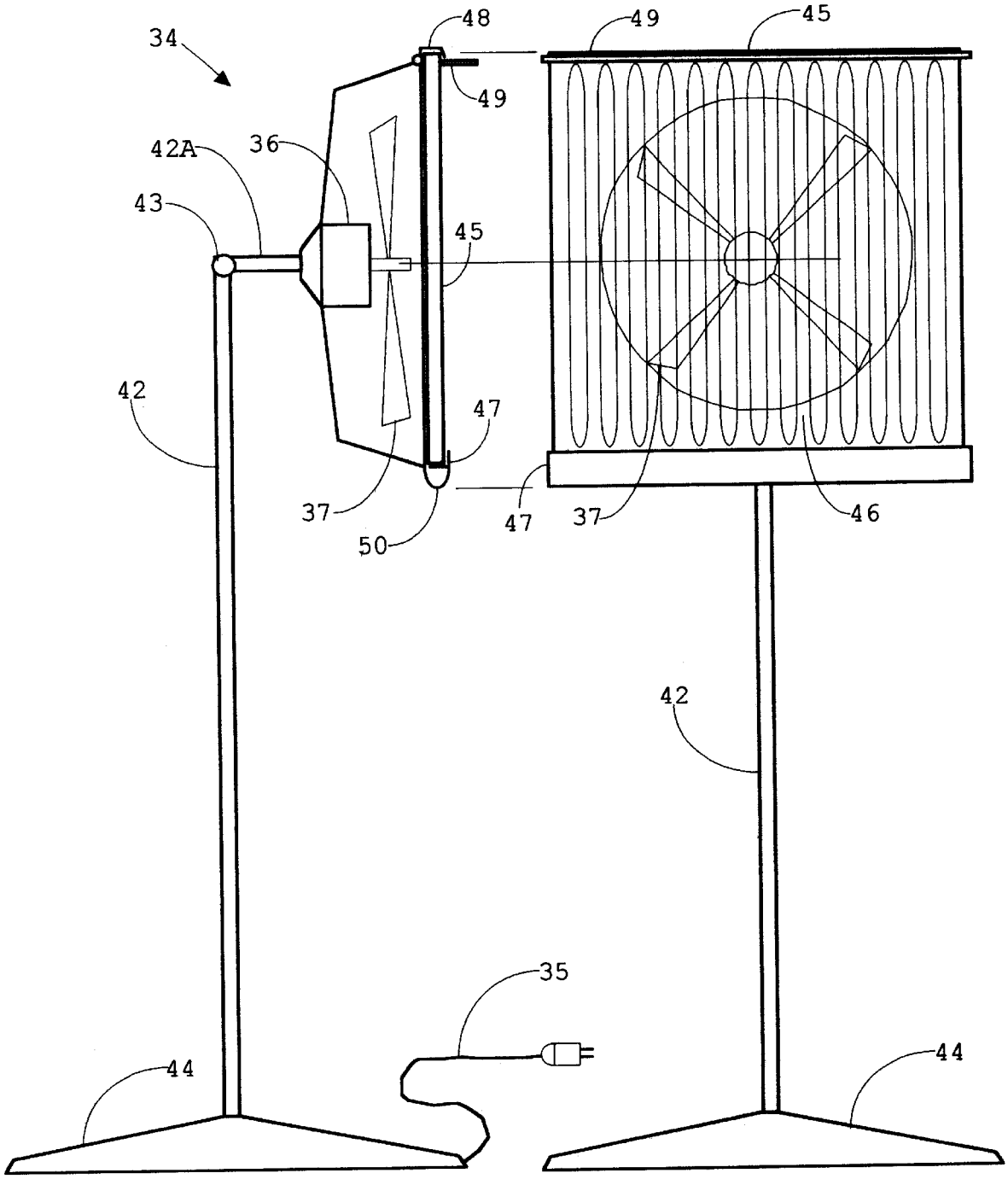
FIG. 10 shows a side view of a portable multifunctional fan including a cooling unit connected to the portable fan.
FIG. 11 shows a front view of a portable multifunctional fan including a cooling unit connected to the portable fan.

FIG. 10 shows a side view of a portable fan 34 comprising a cooling unit 45 a power source 35 and a motor 36 and blades 37 connected to said motor 36 that is powered by 35. Fan 34 includes portable arm 42A and stand 42 connected to 42A using rotational joint 43 and stand leg 44 attached to stand 42. Cooling unit 45 includes a removable grit 46 filled with fluid which is cooled and frozen using an available freezer. FIG. 10 and 11 show a cooling unit 45 attached to a portable fan 34 using slide in-and-out or clip in-and-out connector such as 47. Connector 47 includes lock 48 to secure grit 46 and a condensation water collection and containment chamber 50 that can be drained as needed. Fluid collection and retention chamber can be designed as a part of grit 46 or as a part of connector 47 depending on the size of the fan 34.

While I have fully shown and described embodiments of my apparatus for universal ceiling fan no limitations as to the scope of the present invention should be implied from the foregoing description. The true scope of the present invention is limited only by the following claims.

I claim:

1. A multifunctional stationary fan attached to a ceiling by mechanical means and has connection to an electrical power source comprising a fan motor unit powered by said power source, at least two fan blades connected to said fan motor, a connector, and a cooling unit which includes a removable cooling grid cooled or frozen using an external refrigerator or freezer respectively and said removable cooling grid is filled with fluid and is connected to said multifunctional fan using said connector.

2. Apparatus said forth in claim 1 includes a magnetic connector which connects said stationary fan and said cooling unit.

3. Apparatus said forth in claim 1 includes an UV light filter connected to said multifunctional stationary fan using said connector and powered by electrical connections to said connector.

4. Apparatus said forth in claim 1 includes a cooling unit which includes a removable cooling grid cooled or frozen using an external refrigerator or freezer respectively and said removable cooling grid is filled with fluid and is connected to said multifunctional fan using said connector and has a condensation collection and containment chamber.

5. A multifunctional portable fan comprising a power source and a motor powered by said power source and at least two blades connected to said motor and an universal connector including a male and female connectors and said universal connector is attached to said multifunctional fan and a combination of at least two of the following air quality and quantity improvement devices including an UV light filter connected to said universal connector, an electrostatic filter connected to said universal connector, an ionic filter and ozone generator connected to said universal connector, a chemical filter connected to said universal connector, a physical filter connected to said universal connector, a heating unit connected to said universal connector.

6. A multifunctional portable fan comprising a power source and a motor powered by said power source and at least two blades connected to said motor and a connector and said connector is attached to said multifunctional fan and a cooling unit which includes a cooled or frozen removable and replaceable cooling grit using an external refrigerator or freezer respectively and said grit is filled with fluid, and said cooling unit is connected to said portable multifunctional fan in the direction of air flow generated by said blades using a connector attached said cooling unit.

* * * * *